US005704296A

United States Patent [19]

Gagliardino et al.

[11] Patent Number: 5,704,296

[45] Date of Patent: Jan. 6, 1998

[54] CAST DRAFT SILL WITH LOW PROFILE CENTER PLATE

[75] Inventors: Joseph L. Gagliardino, Pittsburgh; Jeffrey D. Wurzer, Glenshaw; Peter Scott Mautino, Verona, all of Pa.

[73] Assignee: McConway & Torley Corporation, Pittsburgh, Pa.

[21] Appl. No.: 712,520

[22] Filed: Sep. 13, 1996

[51] Int. Cl.[6] ..... B61F 1/00

[52] U.S. Cl. ..... 105/420; 105/199.4

[58] Field of Search ..... 105/199.1, 199.4, 105/228, 420; 384/422

[56] References Cited

U.S. PATENT DOCUMENTS

| | | | |
|---|---|---|---|
| 3,703,239 | 11/1972 | Furniss | 105/420 |
| 3,985,235 | 10/1976 | Buzza | 105/420 |
| 4,128,062 | 12/1978 | Roberts | 105/420 |
| 4,206,710 | 6/1980 | Spence | 105/420 |
| 4,359,003 | 11/1982 | Miller et al. | 105/420 |
| 4,589,348 | 5/1986 | Holabeck et al. | 105/420 |

*Primary Examiner*—S. Joseph Morano
*Attorney, Agent, or Firm*—James Ray & Associates

[57] ABSTRACT

An elongated light-weight, cast draft sill mountable at the end of a center sill of a railway car body, and to which a railway car truck is pivotally mountable, the cast draft sill having a generally hollow, elongated rectangular body, with a pair of elongated, parallel side walls extending perpendicularly from an elongated top wall and further including a draft pocket adjacent to the forward end adapted to receive a coupler yoke and associated draft gear, and a light weight center plate portion which is mateable to a railway car truck spaced from the rearward end of the cast draft sill. The unique center plate portion comprising a generally cubic center plate pocket defined between a pair of spaced and parallel center plate pocket end walls, extending perpendicularly between the parallel side walls of said draft sill, and a floor wall member forming a lower wall of the center plate pocket having a cylindrical periphery extending downwardly from an underside of the draft sill, and having a circular outer face with an aperture axially disposed through the circular outer face to receive a king-pin of the railway car truck.

20 Claims, 2 Drawing Sheets

CAST DRAFT SILL WITH LOW PROFILE CENTER PLATE

FIELD OF THE INVENTION

The present invention relates generally to railway car draft gear, and more particularly relates to a railway car draft sill having a significantly lighter weight center plate design without sacrificing strength, and yet in full compliance with all AAR (American Association of Railroads) specifications.

BACKGROUND OF THE INVENTION

With increasing fuel costs, there is a concerted effort in the railroad industry to increase productivity. Historically, such increases have been achieved by increasing rolling stock and rail car capacities. However, the practical load limit of today's track system has been reached so that attention is being directed in other areas, such as, lightening the weight of rolling stock, which includes the substitution of newer, lighter weight materials where possible without sacrificing strength or unreasonably increasing costs. In addition, practical train lengths and practical speeds at which traffic can operate safely have been reached without improvement in stability and ride quality. Hence, basic equipment designs are being reevaluated not only to lighten weight, but to improve performance, stability and ride quality. Although minor improvements may seem trivial, the over-all benefits to be achieved can be significant, especially when it is realized that in 1994, the railroad industry transported 1.2 trillion ton-miles of lading in a fleet of 1.5 million cars, with an annual revenue of $31 billion.

A rail car draft sill of some design or other is utilized in practically all railway cars, and normally comprises an elongated and rather heavy, box-like steel casting which is secured at each end of a railway car body center sill to which a railway car truck is mounted for pivotal movement for supporting the car on railway track, and into which coupling draft gear is assembled for purposes of joining the ends of two adjacent cars. Draft sills of any design always include center plate in some form or other which in essence comprises a rather heavy cylindrical extension protruding slightly from the bottom rear surface of the cast draft sill, having an aperture through the axis and a flat, circular lower surface to which the railway car truck is rotatably assembled. With a draft sill rigidly attached to each end of the cat's center sill, each with a cylindrical center plate extending downward to engage and rotatably rest upon a car truck, the two car trucks will support the two ends of the railway car. Because of the excessive weight borne by the center plate portion of the draft sill, prior art draft sills are normally designed to include rather heavy supporting gussets to assure that the shape and integrity of the draft sill and the center plate portion extending therefrom are maintained. Accordingly, the entire weight of the railway car is supported by the two railway car trucks through the center plates of the two draft sills, and as a result, the design of the draft sills have tended to be rather heavy for purposes of supporting the weight. For example, prior art draft sills typically have a core portion of the center plate which extend the full height of the draft sill, and in addition include a plurality of supporting gussets extending from the core portion. Prior art draft sills typically weigh about 1500 pounds each, so that two such draft sills per car adds a total weight thereto of approximately 3,000 pounds.

SUMMARY OF THE INVENTION

The present invention is predicated upon the conception and development of a new and improved draft sill whereby the center plate portion thereof has been redesigned not only to eliminate the heavy core portion extending the height of the draft sill, but to further eliminate a major portion of the heavy gussets previously found necessary to support the excessive height of the core portion. Yet pursuant to AAR specifications, the draft sill of this invention includes a striker and a draft pocket adapted to receive a coupler yoke and associated draft gear as specified by the AAR.

In its simplest form, the draft sill of this invention is substantially like those of the prior art as specified by the AAR but incorporates a modified, lightweight center plate portion wherein the heavy core portion and gussets have been replaced by a cubic center plate pocket defined between a pair of spaced and parallel center plate pocket end walls, extending perpendicularly between parallel side walls of the draft sill, and having a cylindrical extension therebelow with a circular floor wall member forming a lower wall of the center plate pocket extending transversely between lower ends of the center plate pocket end walls and extending downwardly from an underside of the draft sill, with an aperture axially disposed therethrough at the axial center of the circular outer face adapted to receive a king-pin of a railway car truck for rotatably securing the railway car truck for rotational movement against the circular outer face. The aperture extends through a tubular extension which is reinforced by gusset flanges interconnecting the tubular extension and the circular floor wall member. As compared to prior art draft sills weighing approximately 1500 pounds each, the draft sill of this invention weighs approximately 1100 pounds thereby capable of lightening the weight of each car by approximately 400 pounds.

OBJECTS OF THE INVENTION

It is, therefore, a primary object of the present invention to provide a new and improved draft sill for railway cars weighing significantly less than comparable prior art draft sills.

Another object of this invention is to provide a new and improved draft sill for railway cars wherein the center plate portion has been redesigned to eliminate the heavy core portion extending the height of the draft sill, as well as eliminate a major portion of the heavy gussets necessary to support the excessive height of the core portion.

A further object of this invention is to provide a new and improved draft sill for railway cars weighing approximately 400 pounds less than comparable prior art draft sills.

In addition to the objects and advantages of the present invention set forth above, various other objects and advantages will become more readily apparent to those persons skilled in the railway art from the detailed description of the invention, particularly, when considered in conjunction with the attached drawings and with the appended claims.

DETAILED DESCRIPTION OF A PREFERRED EMBODIMENT OF THE INVENTION

Figure 2:
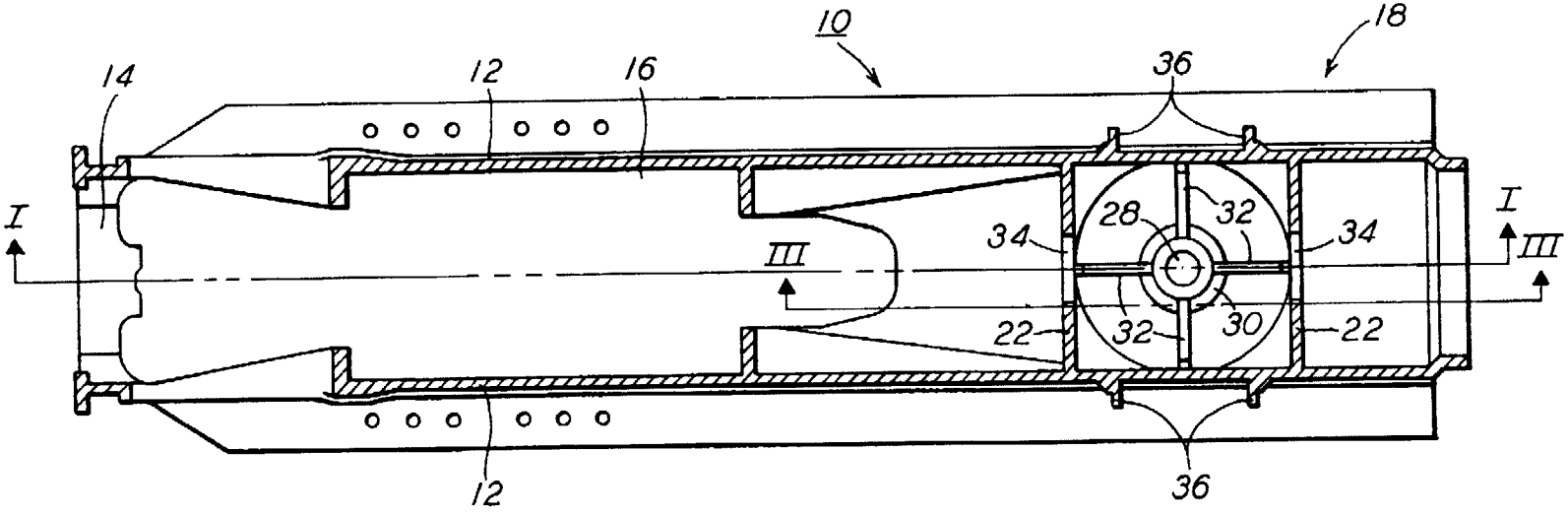
FIG. 2 is a cross-sectional top view of the cast draft sill shown in FIG. 1, with the section taken at line II—II in FIG. 1.

Before describing the present invention in detail, for the sake of clarity and understanding, the reader is advised that identical components having identical functions in each of the accompanying drawings have been marked with the same reference numerals throughout each of the several Figures illustrated herein.

Figure 1:
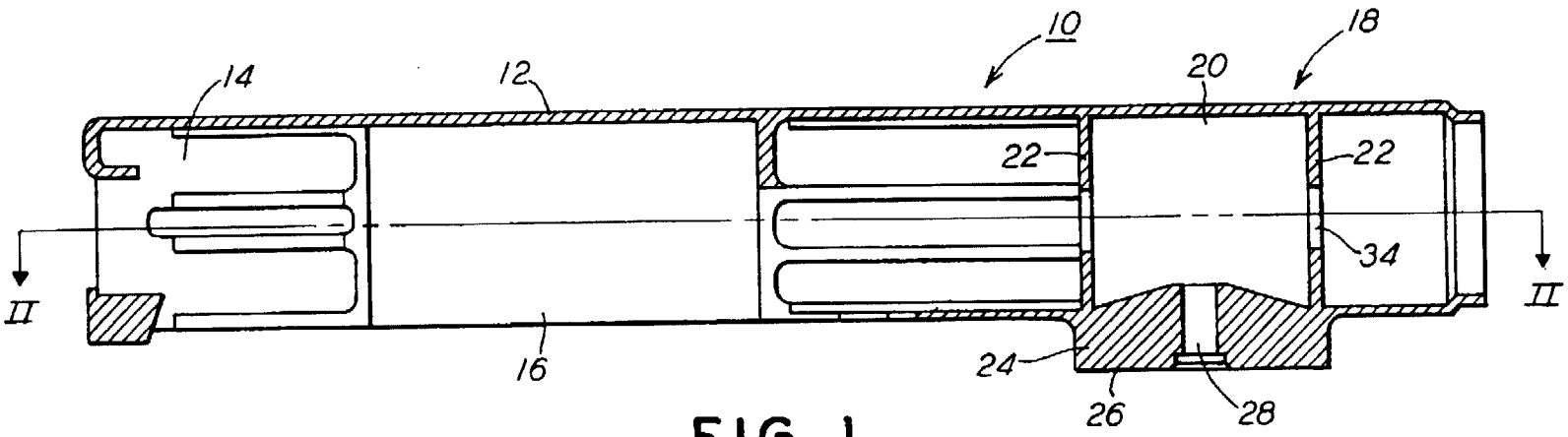
FIG. 1 is a cross-sectional side view of a cast draft sill in accordance with a preferred embodiment of this invention, with the section taken at line I—I in FIG. 2.
Figure 3:
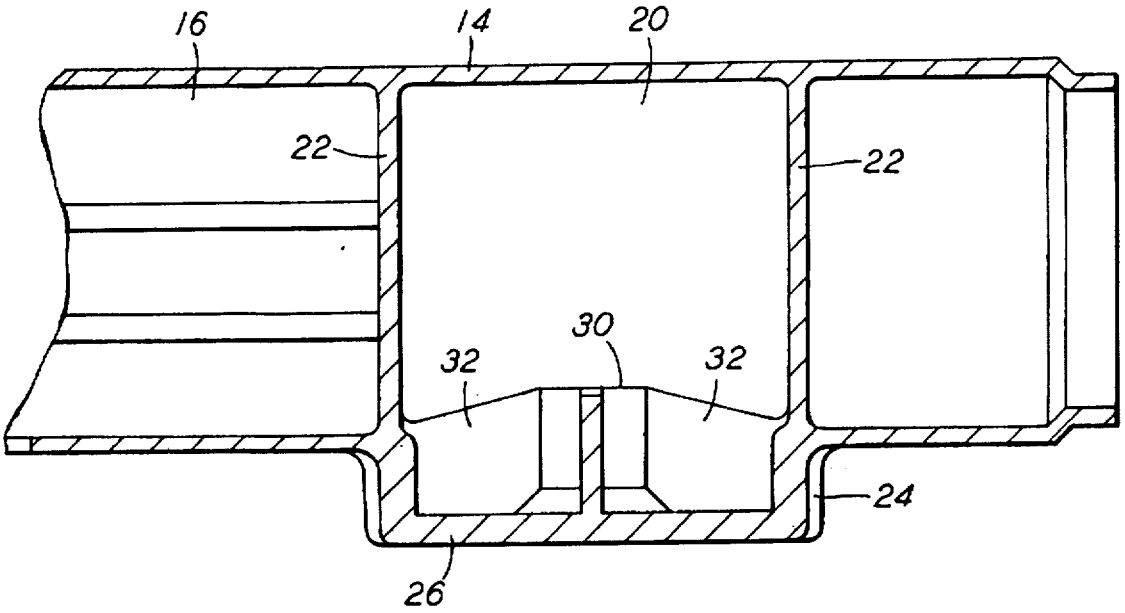
FIG. 3 is an enlarged cross-sectional side view of the center plate portion of the cast draft sill shown in FIGS. 1 and 2 with the section taken through a line III—III, thereby avoiding a section through the gusset flanges so that the section through the floor wall member can be better illustrated.

Reference to FIGS. 1 and 2 will illustrate a presently preferred embodiment of a cast draft sill in accordance with a preferred embodiment of this invention wherein the inventive draft sill 10 comprises a generally hollow, elongated rectangular cast steel body, having a pair of elongated, parallel side walls 12 extending perpendicularly downward from the sides of an elongated top wall 15. A striker 15 is incorporated into the forward end of the draft sill 10 pursuant to conventional prior art practices, as is a draft pocket 16 adjacent to the striker 15. The draft pocket 16 is sized and equipped to receive a coupler yoke (not shown) and associated draft gear (not shown) pursuant to well known conventional prior art practices, and therefore need not be further detailed here.

The crux of this invention resides in the unique, low-weight, low-profile center plate portion 18 which is mateable to a railway car truck (not shown) with the center plate portion 18 spaced from the rearward end of the cast draft sill, pursuant to conventional practices. The unique and inventive center plate portion 18 comprises a generally cubic center plate pocket 20 defined between a pair of spaced and parallel center plate pocket end walls 22, extending perpendicularly between the parallel side walls 12 of the cast draft sill 10. A cylindrical pocket extension 24 extends downwardly from the generally cubic plate pocket 20 to provide a circular floor wall member 26 forming a horizontal lower wall of the generally cubic center plate pocket 20, the floor wall member 26 having a circular outer face. Obviously, the lower portion of the pocket 20 is cylindrical rather than cubic. An aperture 28 is axially disposed through the floor wall member 26 at the axial center of the circular outer face, adapted to receive the king-pin (not shown) of a railway car truck (not shown) upon which the car body (not shown) will be placed. With the king-pin inserted within aperture 28, circular floor wall member 26 will engage the bowl portion (now shown) of the railway car truck thereby permitting the car truck to pivotally rotate thereunder.

Preferably, a shallow tubular extension 30 is provided extending axially upwardly from the center of floor wall member 26 through which aperture 28 extends. Ideally, shallow reinforcing gusset flanges 32 should be provided to reinforce floor wall member 26, and tubular extension 30. An ideal arrangement is to provide four reinforcing gusset flanges 32 at right angles to each other extending radially and tapered downwardly from tubular extension 30 which interconnect tubular extension 30, floor wall member 26 and the cylindrical wall of cylindrical pocket extension 24. In addition side supports such as flanges 36 can be provided on the outer surfaces of side walls 12 adjacent to center plate pocket 18. Such supporting flanges 36 can be provided in any of a number of different forms, with the two parallel, vertical flanges 36 as shown being only exemplary. While not structurally essential, apertures 34 are provided through end walls 22 to provide clean-out apertures for removing sand core material, or the like, after casting, the use of which will be necessary to cast pocket 20.

While the presently preferred embodiment for carrying out the instant invention has been set forth in detail above, those persons of ordinary skill in the railway art may recognize various alternative ways of practicing the invention without departing from the spirit and scope of the appended claims. For example, other means and systems for reinforcing the floor wall member 26 could perhaps work equally well. Of course, the lower surface of floor wall member 26 should be designed to mate with the bowl of the railway car truck into which it will be placed.

In view of the fact that the primary objective of this invention has been to reduce the weight of conventional draft sills without sacrificing strength, and that this has been accomplished by eliminating material therein, specifically the heavy core portion and the gussets that had previously been provided, the draft sill design disclosed herein has been shown to be as strong as the prior art designs, but not necessarily stronger. Therefore, a manufacturer would do well to manufacture the inventive draft sills of a stronger cast steel, such as a high-strength, low-alloy steel in order to increase and optimize strength in spite of the reduced mass of material. In any event, those of ordinary skill in the art will recognize that the foregoing description is merely illustrative and is not intended to limit the invention in any way.

We claim:

1. An elongated unitary light-weight, cast draft sill mountable at the end of a center sill of a railway car body, and to which a railway car truck is pivotally mountable, said cast draft sill comprising:

(A) a generally hollow, elongated rectangular body, having a pair of elongated, parallel side walls extending perpendicularly from an elongated top wall;

(B) a draft pocket adjacent to a first end adapted to receive a coupler yoke and associated draft gear; and (C) a center plate portion which is mateable to such railway car truck spaced from a second end of said cast draft sill, said center plate portion comprising:

(a) a generally hollow cubic center plate pocket defined between a pair of spaced and parallel center plate pocket end walls, extending perpendicularly between said parallel side walls of said draft sill that provides an empty hollow space above a floor wall of said center plate pocket;

(b) a floor wall member forming a lower wall of said generally cubic center plate pocket extending horizontally between lower ends of said center plate pocket end walls parallel to said top wall, said floor wall member having a cylindrical periphery extending downwardly from an underside of said draft sill, and having a circular outer face; and (c) an aperture axially disposed through said floor wall member at an axial center of said circular outer face, said aperture adapted to receive a king-pin of such railway car truck for mating such railway car truck for rotational movement against said circular outer face.

2. An elongated light-weight, cast draft sill mountable at the end of a center sill of a railway car body, according to claim 1, in which said floor wall member is reinforced with integral shallow gusset flanges extending between said floor wall member and the cylindrical sides thereof.

3. An elongated light-weight, cast draft sill mountable at the end of a center sill of a railway car body, according to claim 1, in which an integral tubular extension is provided to extend axially upwardly from said floor wall through which said aperture extends and at a distance that leaves the center plate pocket empty.

4. An elongated light-weight, cast draft sill mountable at the end of a center sill of a railway car body, according to claim 3, in which said tubular extension is reinforced with integral shallow gusset flanges extending between said tubular extension and said floor wall member.

5. An elongated light-weight, cast draft sill mountable at the end of a center sill of a railway car body, according to claim 4, in which four of said integral shallow gusset flanges are provided at right angles to each other extending laterally and axially from said tubular extension.

6. An elongated light-weight, cast draft sill mountable at the end of a center sill of a railway car body, according to claim 5, in which said gusset flanges span from said tubular extension to the cylindrical portion of said floor wall.

7. An elongated light-weight, cast draft sill mountable at the end of a center sill of a railway car body, according to claim 1, in which at least one reinforcing flange is provided extending perpendicularly outward from each of said parallel side walls of said draft sill adjacent to said cubic center plate pocket.

8. An elongated light-weight, cast draft sill mountable at the end of a center sill of a railway car body, according to claim 7, in which two of said reinforcing flanges are provided extending perpendicularly outward from each of said parallel side walls of said draft sill, said two flanges being equally spaced on each side of a vertical plane through said aperture and perpendicularly through each of said side walls.

9. An elongated light-weight, cast draft sill mountable at the end of a center sill of a railway car body, according to claim 1, in which a clean-out aperture is provided through each of said end walls to facilitate removal of casting core material.

10. An elongated light-weight, cast draft sill mountable at the end of a center sill of a railway car body, according to claim 1, in which said draft pocket includes a plurality of shallow tapered gusset flanges extending perpendicularly inward from an inside surface of said side walls within said draft pocket which abut against the surface of an adjacent end wall opposite said cubic center plate pocket.

11. An elongated light-weight, cast draft sill mountable at the end of a center sill of a railway car body, according to claim 10, in which at least two mirror-imaged tapered gusset flanges are provided on each of said inside surface of said side walls within said draft pocket which abut against the surface of an adjacent end wall opposite said cubic center plate pocket.

12. An elongated light-weight, cast draft sill mountable at the end of a center sill of a railway car body, according to claim 1, in which a striker is incorporated into said first end of said draft sill.

13. An elongated light-weight, cast draft sill mountable at the end of a center sill of a railway car body, and to which a railway car truck is pivotally mountable, said cast draft sill comprising:

(A) a generally hollow, elongated rectangular body, having a pair of elongated, parallel side walls extending perpendicularly from an elongated top wall;

(B) a draft pocket adjacent to a first end of said draft sill adapted to receive a coupler yoke and associated draft gear; and (C) a center plate portion which is mateable to such railway car truck spaced from a second end of said cast draft sill, said center plate portion comprising:

(a) a generally hollow cubic center plate pocket defined between a pair of spaced and parallel center plate pocket end walls, extending perpendicularly between said parallel side walls of said draft sill that provides an empty hollow space above a floor wall of said center plate pocket;

(b) a cylindrical pocket extension extending downwardly from said generally cubic plate pocket;

(c) a floor wall member forming a lower wall of said generally cubic center plate pocket extending horizontally under said cylindrical pocket extension parallel to said top wall, said floor wall member having a circular outer face;

(d) an aperture axially disposed through said floor wall member at an axial center of said circular outer face, said aperture adapted to receive a king-pin of such railway car truck for mating such railway car truck for rotational movement against said circular outer face;

(e) a tubular extension extending axially upwardly from said floor wall through which said aperture extends; and (f) a plurality of reinforcing gusset flanges connecting said tubular extension, said floor wall member and said cylindrical pocket extension.

14. An elongated light-weight, cast draft sill mountable at the end of a center sill of a railway car body, according to claim 13, in which four of said gusset flanges are provided at right angles to each other extending laterally and axially from said tubular extension.

15. An elongated light-weight, cast draft sill mountable at the end of a center sill of a railway car body, according to claim 14, in which at least two reinforcing flanges are provided extending perpendicularly outward from each of said parallel side walls of said draft sill adjacent to said cubic center plate pocket, said at least two flanges being equally spaced on each side of a vertical plane through said aperture and perpendicularly through each of said side walls.

16. An elongated light-weight, cast draft sill mountable at the end of a center sill of a railway car body, according to claim 13, in which a clean-out aperture is provided through each of said end walls to facilitate removal of casting core material.

17. An elongated light-weight, cast draft sill mountable at the end of a center sill of a railway car body, according to claim 13, in which said draft pocket includes a plurality of tapered gusset flanges extending perpendicularly inward from an inside surface of said side walls within said draft pocket which abut against the surface of an adjacent end wall opposite said cubic center plate pocket.

18. An elongated light-weight, cast draft sill mountable at the end of a center sill of a railway car body, according to claim 17, in which at least two mirror-imaged tapered gusset flanges are provided on each of said inside surface of said side walls within said draft pocket which abut against the surface of an adjacent end wall opposite said cubic center plate pocket.

19. An elongated light-weight, cast draft sill mountable at the end of a center sill of a railway car body, according to claim 13, in which a striker is incorporated into said first end of said draft sill.

20. An elongated unitary light-weight, cast draft sill mountable at the end of a center sill of a railway car body, and to which a railway car truck is pivotally mountable, said cast draft sill comprising:

(A) a generally hollow, elongated rectangular body, having a pair of elongated, parallel side walls extending perpendicularly from an elongated top wall;

(B) a striker incorporated into said first end of said draft sill;

(C) a draft pocket adjacent to said striker adapted to receive a coupler yoke and associated draft gear; and (D) a hollow center plate portion which is mateable to such railway car truck spaced from a second end of said cast draft sill, said hollow center plate portion comprising:

(a) a generally cubic center plate pocket defined between a pair of spaced and parallel center plate pocket end walls, extending perpendicularly between said parallel side walls of said draft sill that provides an empty hollow space above a floor wall of said center plate pocket;

(b) a cylindrical pocket extension extending downwardly from said generally cubic plate pocket;

(c) a floor wall member forming a lower wall of said generally cubic center plate pocket extending horizontally under said cylindrical pocket extension parallel to said top wall, said floor wall member having a circular outer face;

(d) an aperture axially disposed through said floor wall member at an axial center of said circular outer face, said aperture adapted to receive a king-pin of such railway car truck for mating such railway car truck for rotational movement against said circular outer face;

(e) a shallow tubular extension extending axially upwardly from said floor wall through which said aperture extends and at a distance that leaves the center plate pocket empty; and (f) four shallow reinforcing gusset flanges connecting said tubular extension, said floor wall member and said cylindrical pocket extension, said gusset flanges disposed at right angles to each other extending laterally and axially from said tubular extension.

* * * * *